US010618612B2

(12) United States Patent
Doig et al.

(10) Patent No.: US 10,618,612 B2
(45) Date of Patent: Apr. 14, 2020

(54) SYSTEMS AND METHODS RELATED TO MARINE FENDERS

(71) Applicant: Superior Innovations Group, LLC, West Bend, WI (US)

(72) Inventors: Thomas S. Doig, West Bend, WI (US); Lucas J. Johnson, Chippewa Falls, WI (US)

(73) Assignee: Superior Innovations Group, LLP, West Bend, WI (US)

( * ) Notice: Subject to any disclaimer, the term of this patent is extended or adjusted under 35 U.S.C. 154(b) by 0 days.

(21) Appl. No.: 16/175,411

(22) Filed: Oct. 30, 2018

(65) Prior Publication Data

US 2019/0127033 A1 May 2, 2019

Related U.S. Application Data

(60) Provisional application No. 62/707,296, filed on Oct. 30, 2017.

(51) Int. Cl.
*B63B 59/02* (2006.01)
*B63B 35/34* (2006.01)

(52) U.S. Cl.
CPC ..... *B63B 59/02* (2013.01); *B63B 35/34* (2013.01)

(58) Field of Classification Search
CPC ..... B63B 59/02; B63B 35/34
See application file for complete search history.

(56) References Cited

U.S. PATENT DOCUMENTS 4,098,211 A * 7/1978 Files ..... E02B 3/26 405/213
2006/0207486 A1* 9/2006 Ayoub ..... B63B 59/02 114/219

* cited by examiner

*Primary Examiner* — Stephen P Avila
(74) *Attorney, Agent, or Firm* — Smith Keane LLP

(57) ABSTRACT

Systems and methods directed to marine fenders include fender rotation through a vertical plane while translating horizontally. Fenders are extended and retracted radially outwardly from and radially inwardly to a marine vessel by at least one electrically or pneumatically controlled and/or operational linear actuator. If a plurality of fenders are provided on a starboard and/or port side of the marine vessel, all of the plurality on a particular side may be activated substantially contemporaneously by control from the helm of the marine vessel, such as a recreational pontoon boat.

11 Claims, 13 Drawing Sheets

FIG.5

SYSTEMS AND METHODS RELATED TO MARINE FENDERS

RELATED APPLICATIONS

This application claims the benefit of co-pending U.S. Provisional Patent Application Ser. No. 62/707,296, filed 30 Oct. 2017, and entitled "Auto-Fender Push-Button Pontoon Fenders," which is incorporated herein by reference in its entirety.

BACKGROUND OF THE INVENTION

The present invention relates generally to actuation devices and more particularly to marine accessories, such as a vessel fender. A vessel or boat fender may be used by vessel operators or dock workers in an attempt to protect their boat from contacting a dock, pier, seawall or other such structure during docking and/or mooring.

While available in a variety of different sizes, shapes and designs, a typical prior marine fender included an air-filled, substantially cylindrical device that may be placed at various locations along a vessel port or starboard side to protect from direct contact with a dock, pier or seawall, for example, to which a boat is or is to be secured. Multiple fenders may be used at port and/or starboard sides with a typical application including at least one fender at the bow (fore) area and one fender at the stern (aft) area at the port and/or starboard sides of the boat. In some applications, boaters may use additional fenders that may be placed, strategically, along the port or starboard (or fore or aft) sides of the boat.

A marine fender absorbs the kinetic energy of a boat or vessel berthing or otherwise being forced against a jetty, dock, pier, seawall or other vessel (hereafter referred to as a dock), for example. Fenders may be used on all types of personal and commercial vessels, from cargo ships, ferries, barges, to fishing and sailing vessels, personal watercraft and yachts. Fenders are used to prevent or minimize damage to vessels and berthing structures. To do this, fenders preferably have high energy absorption and low reaction force. In other words, marine fender systems are preferably not substantially underdamped, and are more preferably overdamped or critically damped, so as to minimize force oscillations. Fenders are typically manufactured out of rubber, foam elastomer or plastic. Rubber fenders may be either extruded or molded. The type of fender that is most suitable for an application depends on many variables, including dimensions and displacement of the vessel, maximum allowable stand-off, berthing structure, tidal variations and other berth-specific conditions.

While larger vessels such as cargo ships and barges, for example, often have fenders that are essentially immovably affixed or mounted to the vessel, smaller boats, such as pontoon boats and recreational boats, may not have fenders that are securely affixed to the port and/or starboard sides of the boat. Rather, portable fenders must usually be manually placed and positioned along the sides of the boat, as required, when berthing against a dock.

When a boat (e.g., a recreational pontoon boat) is under way, fenders are often stowed or secured on deck in a storage compartment(s), such as under hinged seats, for example. A typical fender for a pontoon boat may be about six to about eight inches in diameter and may be about sixteen to about twenty-four inches in length. A single vessel usually carries multiple (e.g., 2, 4, 8, or any other plurality) fenders at once. Fender storage utilizes sparse vessel storage space that may otherwise be used for other items such as coolers, fishing equipment, towels, clothing or sporting accessories (e.g., life jackets, skis, tubes, etc.), for example.

When preparing for berthing against a dock, a captain and/or crew member(s) must place fender(s) at various locations along the sides of the boat. Attached to the vessel by a line at one end, the fenders may be hung or dangled over the side of the boat. The line (e.g., rope, chain, cable) may be secured to the boat such that the fender hangs down along the side of the boat, preferably radially outward covering a furthest outward portion of the boat, such as a bumper. The fender ultimately contacts the side of the boat on one side of the fender and dock on the other side of the fender, thereby preventing the boat from hitting the dock and/or the dock hitting the boat. Properly placed, the fenders may be placed along the side(s) of the boat prior to reaching the dock. Should the captain be placing the fenders, he or she may have to stop the boat before reaching the dock, place the fenders as required and then proceed to the dock. If the crew is placing the fenders, they may do so, typically at slow speed and within the confines of the harbor, for example, yet still prior to reaching the dock such the fenders are placed before the boat reaches the dock.

Unfortunately, there are variations in dock structures and dock heights with relation to any plurality of vessels or portions (e.g., gunwales) thereof, so fenders must often be placed at varying heights and/or locations about the port sides of the boat depending on the application. While fender placement may be predictable after repeated berthing of the same vessel at the same dock under similar environmental conditions (e.g., wind and water level), placement may be unpredictable with inexperienced captain and/or crew, at unfamiliar dock(s), and/or under varied environmental conditions. Further, when pulling up to a dock, for example, fender position may not be predeterminable because a mooring position may not be visible in time to place fenders properly. Accordingly, duplicative fenders may be required, such that fenders are provide about the perimeter of the boat when fewer fenders could have been employed if a mooring position was determinable. As stated above, fenders are usually aligned sufficiently so that the fender is placed radially outwardly between the boat and the dock thus preventing or minimizing physical contact between the boat and the dock.

As a vessel departs a dock and is underway, fenders may be pulled up from the side(s) of the boat, the lines un-tied and the fenders stored. If the captain is retrieving the fenders, he or she may have to, again, stop the boat and proceed in retrieving and storing the fenders. If the crew is tending to the fenders, this may be done while the boat is under-way and perhaps idling through the marina, for example.

Notwithstanding some disadvantages, prior fenders can be somewhat effective in bodies of water where the water level fluctuates due to tides, surge or rivers, if the dock is a floating dock because as the water level changes, the boat and the dock will rise and fall at the time, thereby causing a particular vertical spacing (e.g., between a horizontal plane including the boat's gunwale and a horizontal plane including a deck of the dock) to remain substantially consistent. Assuming that prior fenders are properly positioned, floating docks may not typically pose a height problem. Floating docks may, however, provide obstacles (e.g., support or safety structures) along their length, thereby complicating fore-aft fender positioning.

Stationary (e.g., non-floating or ground-supported) docking structures may present both vertical and horizontal docking challenges. For example, prior fenders can be somewhat problematic on bodies of water where the water level fluctuates due to tides, surge or rivers, if the dock a non-floating or ground-anchored dock. Where the dock is non-floating, as water levels fluctuate, the boat will rise and fall, but the dock remains at the same height, thereby causing a particular vertical spacing (e.g., between a horizontal plane including the boat's gunwale and a horizontal plane including a deck of the dock) to change due to changing environmental conditions. As the water level rises or falls, prior line-supported fenders will also rise and fall (with the boat) and may therefore not necessarily maintain their "ideal" position between the boat and dock.

Popular prior fenders are pneumatically inflated. Some pneumatic fenders have a fill valve, while others are sealed. An inflated fender is subject to breaking, tearing or otherwise losing its air which may lessen its effectiveness or completely render the fender useless. Should this occur without knowledge (in the middle of the night, for example) the boat may not be properly protected and damage could occur to the boat, the dock or both the boat and dock. Fenders that are inflated but do not have a fill-valve can be affected by temperature variations. For example, a fender that is sufficiently full of air at 80 degrees Fahrenheit may not be sufficiently full of air at 20 degrees Fahrenheit. The false sense of security based on this example may cause the fender to "fail" (e.g., damage to boat, dock, or both) at colder temperatures.

Considering that prior fenders were simply tied to a boat rail, fence or cleat, for example, the fenders may easily be lost or even stolen as there is really no way practical way to attach them to the boat securely. In some applications, these same fenders may be attached to the dock in which case they are used with the same intention of isolating the boat from the dock however, in this case, the fenders are affixed to the dock instead of the boat. In either case, prior fenders whether attached to the dock or the boat, is susceptible to some or perhaps all of the same challenges as described above.

SUMMARY OF THE INVENTION

According to an aspect of an embodiment of a marine fender system according to the present invention, the system includes a fender and a pushrod coupled to the fender. The pushrod is reciprocally moveable between and including a first longitudinal position and a second longitudinal position. Longitudinal movement of the pushrod translates to substantially horizontal translation of the fender, and rotation of the pushrod about its longitudinal axis translates to rotation of the fender in a substantially vertical plane. As the pushrod moves between the first longitudinal position and the second longitudinal position, the pushrod rotates a predetermined angle of less than one hundred eighty degrees. The rotation through the predetermined angle may occur throughout the entirety of the horizontal translation or through less than the entirety.

According to another aspect of an embodiment of a marine fender system according to the present invention, the system includes an actuator, such as a linear electrical and/or pneumatic actuator, operatively coupled to the pushrod to impart longitudinal movement to the pushrod.

According to still another aspect of an embodiment of a marine fender system according to the present invention, the pushrod supports at least one rotational guide member at a longitudinal location along a length of the pushrod. The rotational guide member(s) may be a radial protrusion from the pushrod (e.g., a pin or bump) or a bearing cam follower.

According to yet another aspect of an embodiment of a marine fender system according to the present invention, the system includes a stationary rotational guide sleeve disposed circumferentially about the pushrod and a race defined along an inner surface of the guide sleeve. The rotational guide member is received within the race.

According to a further aspect of an embodiment of a marine fender system according to the present invention, a bumper may be disposed on at least one of an outer surface of the fender and an inner surface of the fender. The bumper may have a lower durometer than the fender.

According to an aspect of an embodiment of a marine vessel according to the present invention, the vessel (e.g., a recreation pontoon boat) has a port side and a starboard side. A first plurality of fenders is disposed along one of the port side and the starboard side. A plurality of pushrods is provided, each being coupled to one of the fenders, the pushrods being reciprocally moveable between and including a first longitudinal position and a second longitudinal position. Longitudinal movement of each pushrod translates to substantially horizontal translation of the respective fender and rotation of each pushrod translates to rotation of the respective fender in a substantially vertical plane. As each pushrod moves between the first longitudinal position and the second longitudinal position, the pushrod rotates a predetermined angle of less than one hundred eighty degrees. The rotation through the predetermined angle may occur throughout the entirety of the horizontal translation or through less than the entirety. Each pushrod may be independently reciprocally moveable or the pushrods may be coupled together, or the pushrods may be actuated substantially contemporaneously.

According to another aspect of an embodiment of a marine vessel according to the present invention, the vessel includes at least one linear actuator operatively coupled to the pushrods to impart longitudinal movement to the pushrods. Each pushrod may have its own dedicated linear actuator. Linear actuators may be outward facing or inward facing, such that an extension of one of the linear actuators causes a radially outward or inward, respectively, longitudinal movement of the respective pushrod with respect to the vessel.

According to an aspect of a method according to the present invention, the method includes the steps of on a marine vessel having a port side and a starboard side, horizontally translating a fender radially outwardly from one of the port side and the starboard side. During the horizontally translating step, the fender is rotated in a vertical plane through an angle of greater than zero and less than one hundred eighty degrees, such as about forty-five to about ninety degrees. The rotation through the predetermined angle may occur throughout the entirety of the horizontal translation or through less than the entirety.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
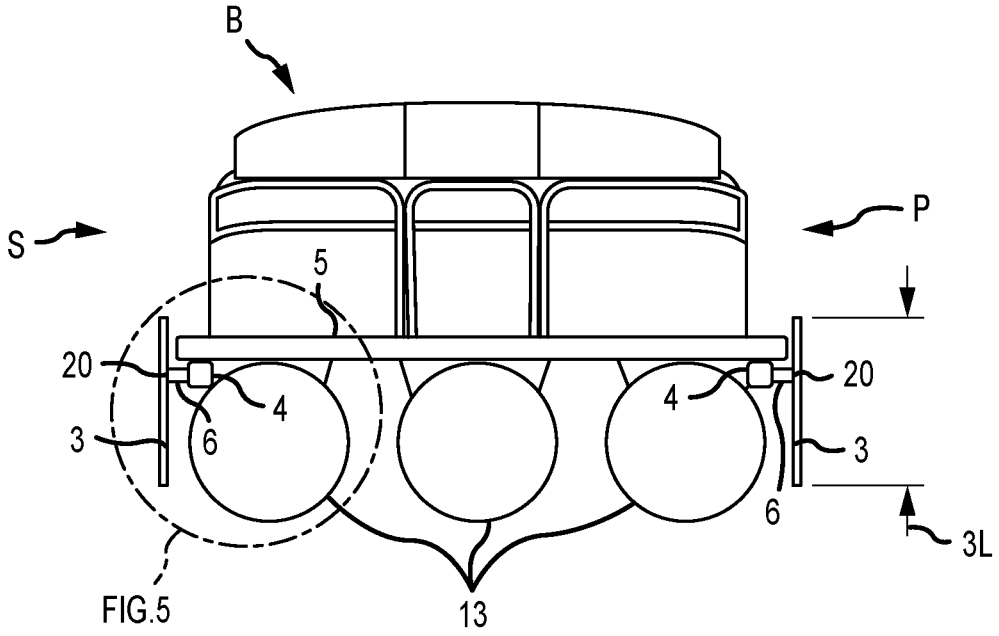
FIG. 1 is a first front elevation view of a pontoon boat system according to the present invention.

Turning to FIG. 1, a pontoon boat B includes a port side P and a starboard side S. The boat B is fitted with at least one but preferably a plurality of fenders 3. One or more, or each, of the fenders are sized and configured to extend in a first configuration radially portwardly or starboardly beyond a majority of the remainder of the perimeter of the boat B. This FIG. 1 generally shows fenders 3 extended or deployed such that the fenders 3 are vertically oriented along a length 3L. The fenders 3 may be any reasonable dimensions (e.g., length, width and thickness) suited for an application for which they are used. In a typical pontoon boat application, the fenders 3 may be made from a materials such as a high-density polyethylene (HDPE) or an ultra-high molecular weight polyethylene (UHMW), for example, that can withstand the rigors of a marine environment. The fenders 3 may alternatively be formed from a metal, such as aluminum. Each fender 3 may be (3"×20"×¾, for example), or other such size that would allow the fenders 3 to function properly and preferably last for a reasonable period of time (e.g., at least several months or years) before needing to be replaced due to wear or breakage.

Mounting brackets 4 support the fenders 3 on the boat B. The brackets 4 are shown in FIG. 1 as being mounted underneath the deck 5 of the boat B and on each of the port side P and starboard side S of the boat B. A pair of support arms 6 extends between each fender 3 and mounting bracket 4, movable from a first deployed position shown in FIG. 1 (and FIGS. 8 and 10) to a second stowed position shown in FIG. 2 (and FIGS. 9 and 11), and vice-versa. When the arms 6 are in the first position, each respective fender 3 is preferably positioned radially outwardly beyond any vertical impediment to rotation of the fender 3, such as a boat deck 5 or pontoon 13.

Figure 2:
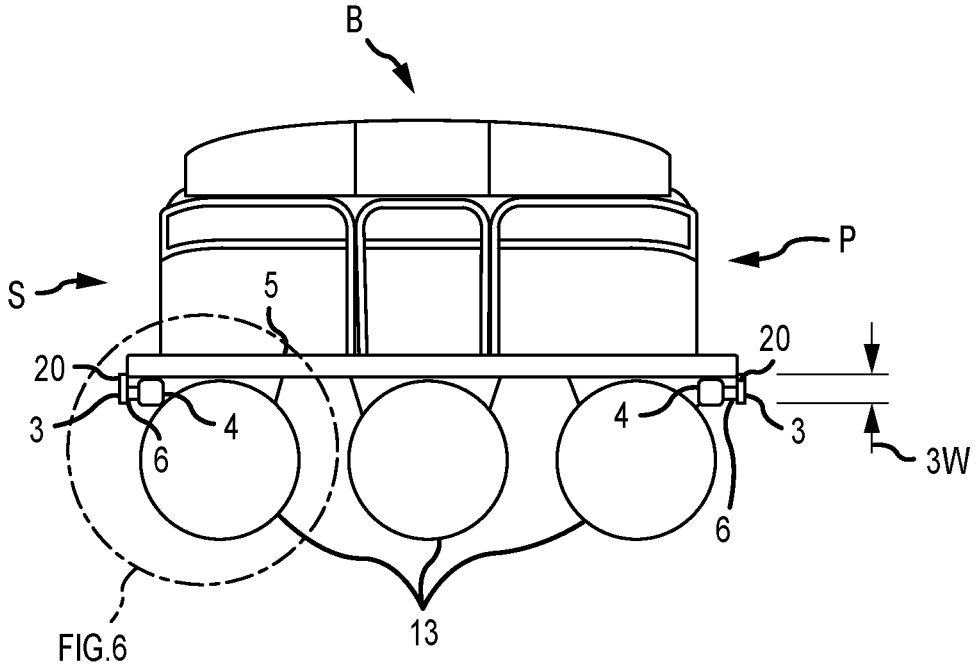
FIG. 2 is a second front elevation view of the system of FIG. 1.

FIG. 2 depicts the boat B of FIG. 1, with the fenders 3 retracted or stowed in a second position. In this second position, the fenders 3 may be stowed in a horizontal orientation, such that the length 3L is disposed substantially horizontally. As a fender 3 moves from the first, deployed position to the second, stowed position, it not only experiences lateral motion (i.e., being withdrawn medially), but also rotation through a predetermined angle of greater than zero and less than one hundred eighty degrees (e.g., rotation of the fender length 3L through approximately ninety degrees, from at least substantially vertical to at least substantially horizontal). Similarly, when a fender 3 moves from the second, stowed position to the first, deployed position, it not only experiences lateral motion (i.e., being extended radially), but also rotation through a predetermined angle of greater than zero and less than one hundred eighty degrees (e.g., rotation of the fender length 3L through approximately ninety degrees, from at least substantially horizontal to at least substantially vertical). When in the second, stowed position, a fender 3 preferably resides underneath the deck 5 and may refrain from extending or protruding radially outwardly beyond the deck 5 or other vessel structure. In this way, preferred fender orientation in the second stowed position may be prevented from increasing the overall beam or width of the vessel B, which may be regulated by law (such as about a 102-inch maximum width for trailering a pontoon boat).

Figure 3:
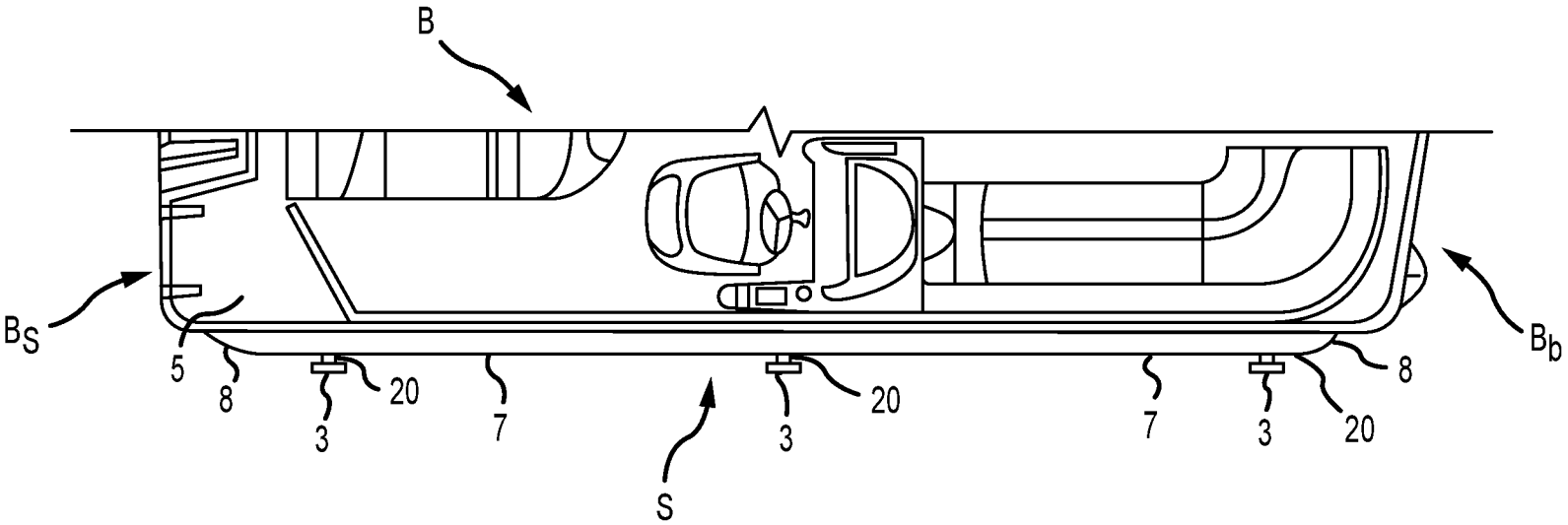
FIG. 3 is a partial top plan view of the system of FIG. 1.

FIG. 3 is a top plan view of the starboard side S of the pontoon boat B with the fenders 3 deployed. As shown, there are preferably a plurality of fenders 3 along the starboard side S, such as at least one fender 3 located closer to a bow portion $B_b$ of the boat B and one fender 3 located closer to a stern portion $B_s$ of the boat B. Additional fenders 3 may be added, such as an additional fender 3 located approximately half-way between the bow fender and the stern fender. While a typical application may require at least one fender 3 at the bow area $B_b$ and one fender 3 at the stern area $B_s$, one may choose to include any reasonable number of fenders 3 along the port side P and/or starboard side S of the boat B. Note that while FIG. 3 depicts a starboard side S of the boat B, a similar or identical (mirror image) arrangement may be employed on the port side P.

Figure 4:
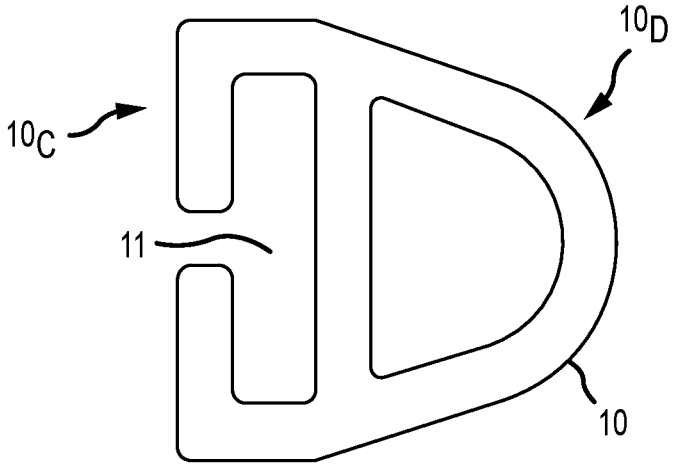
FIG. 4 is an elevation view showing a cross-section of a bumper according to the present invention.

FIG. 4 is an end-view of a bumper 10 that may be incorporated into a marine fender system according the present invention. There may be situations in which a softer fender interface is desired to be disposed outwardly towards a dock. In other words, it may be desirable to provide a material supported on the fender to provide an increased dampening effect as compared to the relatively low dampening effect of a bare fender 3 that may be made from aluminum, HDPE or UHMW material as discussed earlier. While a standard fender 3 may suffice in most applications, a bumper 10 may be used in applications where the boat is subjected to or expected to be subjected to waves, for example, whereby a dampening rubber-type bumper 10 may dampen the shock as the waves cause the boat B to move up and down, back and forth and/or in and out against a dock or seawall. Additionally or alternatively, a bumper 10 may be provided to more seamlessly blend the fender 3 into a boat aesthetic, such that when the fender 3 is positioned in the second, retracted position, the bumper 10 appears to be a continuation of a perimeter bumper otherwise provided on the boat B. The bumper 10 may be formed from a molded or extruded rubber-type product such as an ethylene propylene diene monomer (EPDM) rubber suitable for marine applications and environments, including but not limited to salt-water environments and applications.

The bumper 10 may be extruded to include a D-shaped portion $\mathbf{10}_D$, back-to-back coupled to or formed integrally with a C-shaped portion $\mathbf{10}_C$, defining a T-slot 11. The T-slot 11 may be slid onto or over the fender 3 and held in place by frictional contact between the C-shaped portion $\mathbf{10}_C$ and the fender 3 and/or may be pinned or otherwise locked in place on the fender 3 such that it may not be removed or will not slide or fall off of the fender 3 without the locking pin(s) or other such mechanical fastener (not shown) being removed thus allowing the bumper 10 to be slid off of the fender 3.

Figure 5:
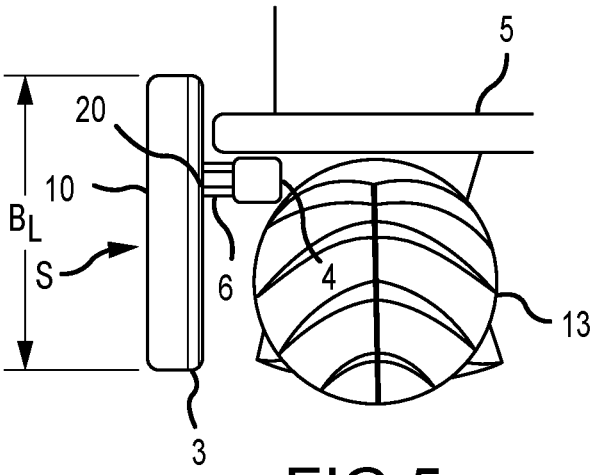
FIG. 5 is a front elevation view of a starboard side of the pontoon boat system according to FIG. 1, further depicting an installed bumper.

FIG. 5 is a front elevation view of the starboard side S of a pontoon boat B showing a deployed fender 3 with a bumper 10 as discussed in FIG. 4 above. The bumper 10 may be of any reasonable size and may extend along a longitudinal length $B_L$, which is preferably substantially similar or nearly identical to the length $\mathbf{3}_L$ of the fender 3 to which it is affixed. The bumper 10 may be air-filled (e.g., having sealed or open ends) or a compression-type bumper 10 (e.g., solid rubber or open- or closed-cell foam).

Figure 6:
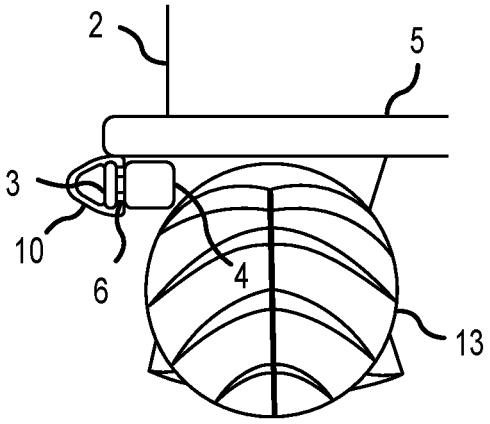
FIG. 6 is a front elevation view of a starboard side of the pontoon boat system according to FIG. 1, further depicting an installed fender stop

FIG. 6 is a front elevation view of the starboard side S of a pontoon boat showing a stowed fender 3 with a bumper 10 that is protruding radially outwardly further than the deck 5. As discussed earlier, the bumper(s) 10 may or may not be used depending on the application. In FIG. 6, the fender 3 and attached bumper 10 are shown in the stowed orientation of the fender 3 as compared to FIG. 5 which showed the bumper 10 attached to deployed fender 3. Again, the fender 3 may be of any reasonable size. Designed in a similar fashion to the design from FIG. 4, the bumper 10 may protrude outward from the boat deck 5 any reasonable distance with perhaps three inches to about six inches (e.g., 3"-6") being typical. In any event and as discussed earlier, a protruding fender 3 that sticks out past the boat deck 5, assuming that the beam is already 102", may need to be removed, on both the port side P and/or starboard side S of the boat, if applicable, prior to trailering the boat B. Alternatively, as will be described further, the bumper(s) 10 may be retracted sufficiently to prevent the overall width of the boat B from exceeding a predetermined maximum width.

Figure 7:
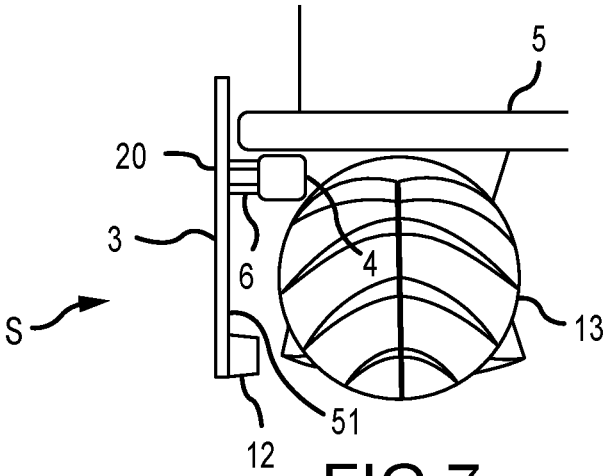
FIG. 7 is a front elevation view of a starboard side of the pontoon boat system according to FIG. 2.

FIG. 7 is a front elevation view of the starboard side S of a pontoon boat B showing a deployed fender 3, further including a fender-stop 12 affixed to or formed integrally with an interior (e.g., facing the nearest pontoon 13) surface 51 of the fender 3. The fender-stop 12 may be a bumper 10 as described with reference to FIG. 4, above, whereby a short section (e.g., having a length of approximately or identically the dimension of the width 3W of the fender 3) of a bumper 10 may be affixed to the interior surface of the fender 3 to make direct contact with the pontoon 13 should a load or force be applied to a lower portion of the fender 3 when in the deployed position. As an example, a load or force applied to the lower portion of the fender 3 may result in the fender 3 bending inward toward the pontoon 13 and given enough force applied to the fender 3, the fender 3 may flex enough such that it physically contacts the pontoon 13. If a fender-stop 12 is not used, the fender 3 may bend so far that it could break or perhaps become deformed. The fender-stop 12 would not only dampen the shock as the fender 3 was being bent inward toward the pontoon 13 but it would lessen the distance traveled by the fender 3 as the fender-stop 12 would essentially be between the fender 3 and the pontoon 13. Further, the fender-stop 12 would keep the hard plastic from the fender 3 from making direct contact with the pontoon 13 which may otherwise cause potential damage to the pontoon 13 should the fender 3 be allowed to continually hit or rub against a specific spot on the pontoon 13.

FIGS. 8-12 show an embodiment of a deployable fender assembly FA1 according to the present invention utilizing a first embodiment of an actuation mechanism 9 according to the present invention. The fender assembly FA1 includes a fender 3 coupled to and supported by the actuation mechanism 9. The actuation mechanism 9 includes a linear actuator 9A capable of moving a pushrod PR in a reciprocating linear motion. The linear actuator may be an electrically or pneumatically controlled actuator as is known in the art. The pushrod PR is operatively coupled to a drive pin 40, which extends between first and second portions of a swingarm bracket 16, which may be a U-shaped bracket. The actuation mechanism 9 further comprises two pairs of swing arms 6, each swing arm 6 extending in from a first end pivotally supported at a mounting bracket 4 to a second end pivotally supported at a swing arm plate 6. Generally, each pair of swing arms 6 is arranged substantially coplanar and perpendicular to a substantially vertical axis of rotation. The mounting bracket 4 supports one end of each of the four swingarms 6 and is also used to mount the assembly FA1 to the marine vessel (e.g., a pontoon boat).

Figure 8:
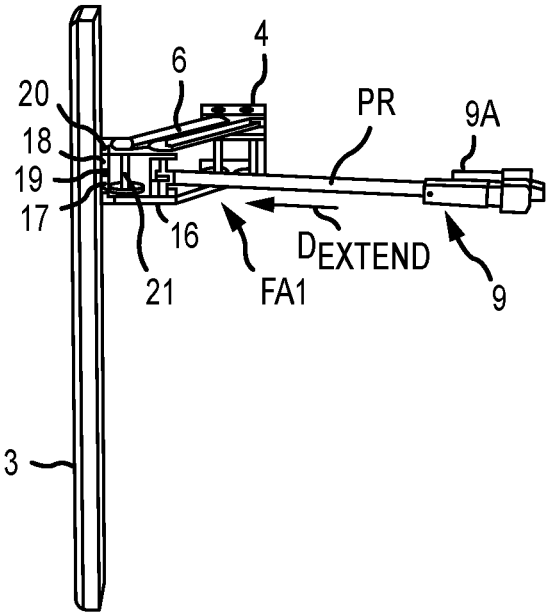
FIG. 8 is a first perspective view of an embodiment of a deployable fender assembly according to the present invention utilizing a first embodiment of an actuation mechanism according to the present invention.
Figure 9:
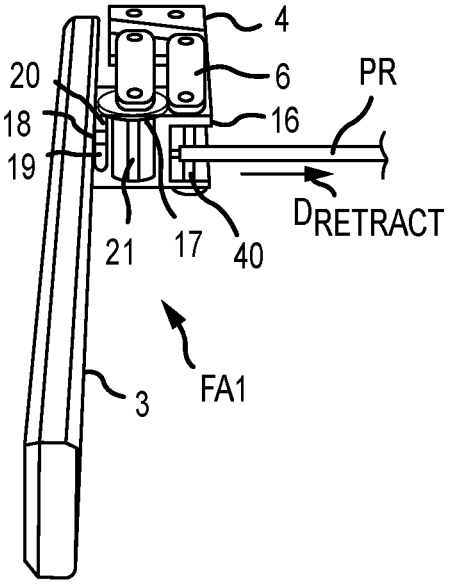
FIG. 9 is a second perspective view of the embodiment of FIG. 8.
Figure 10:
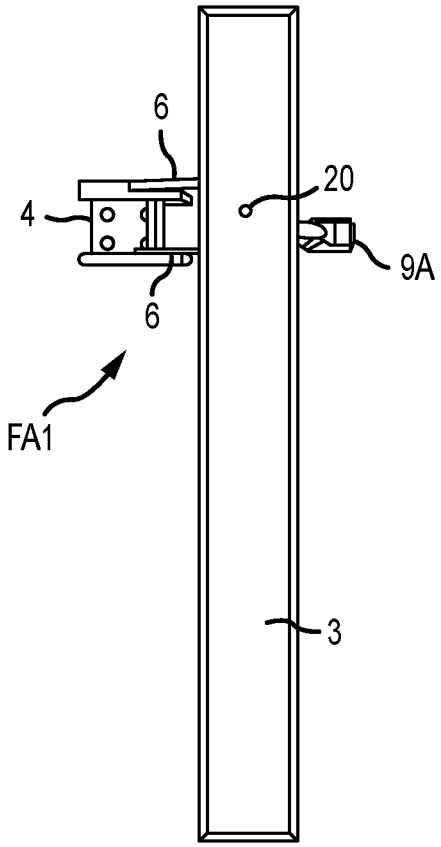
FIG. 10 is a first elevation view of the embodiment in FIG. 8.
Figure 11:
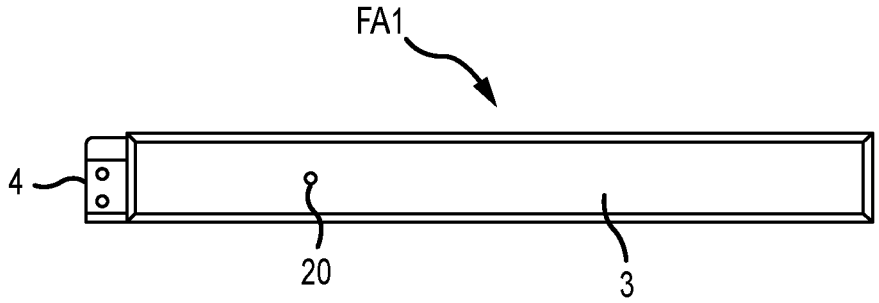
FIG. 11 is a second elevation view of the embodiment of FIG. 8.
Figure 12:
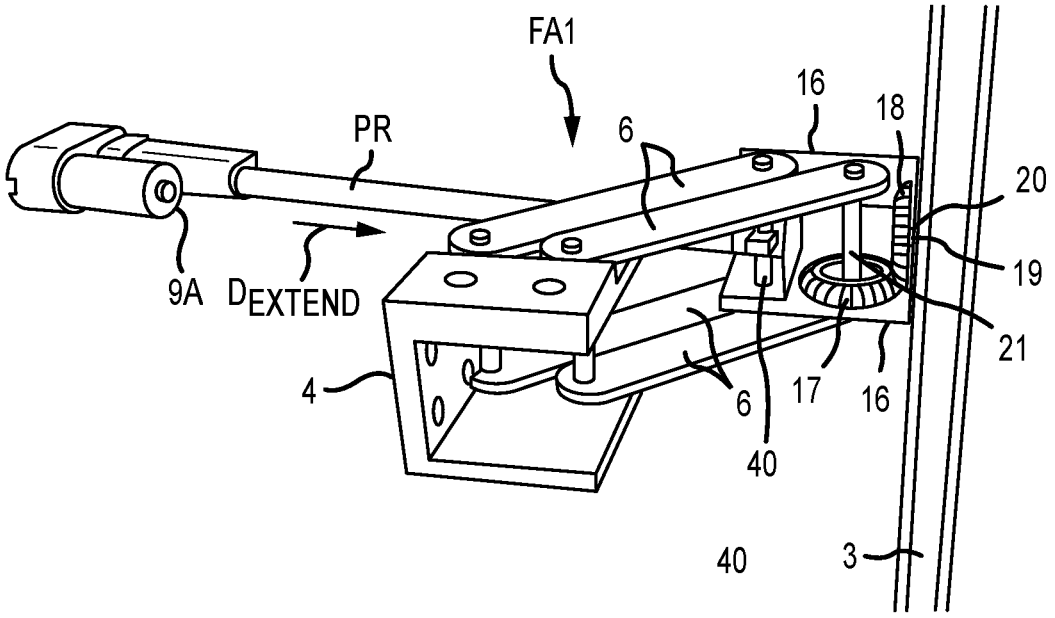
FIG. 12 is a rear perspective view of the embodiment of FIG. 8.

It may be desirable in operation to allow or force the fender 3 to rotate in a substantially vertical plane while moving radially outward from the boat B (e.g. substantially horizontally). This fender assembly FA1 employs a mechanical rotational mechanism including a plurality of bevel gears, which may be disposed in the swingarm bracket 16. A fender 3 is extended (radially outwardly) towards a deployed position (as shown in FIGS. 8, 10, and 12) when the pushrod PR is moved in a first direction $D_{Extend}$ by the actuator 9A. A fender 3 is retracted (radially inwardly) towards a stowed position (as shown in FIGS. 9 and 11) when the pushrod PR is moved in a second direction $D_{Retract}$ (preferably opposite the first direction $D_{Extend}$) by the actuator 9A.

As the pushrod PR is extended by the actuator 9A, the swingarms 6 rotate outward while the fender 3 simultaneously rotates (e.g., from substantially horizontal to substantially vertical). As the pushrod PR is retracted by the actuator 9, the swingarms 6 rotate inward while the fender 3 simultaneously rotates (e.g., from substantially vertical to substantially horizontal). The rotation of the fender 3 in a vertical plane during horizontal movement can be accomplished via the use of bevel gears which will be discussed in more detail in FIG. 12.

With reference to FIG. 12, the fender assembly FA1 is shown in an extended position, the fender 3 having been deployed as the actuator 9A forced the pushrod PR outward (along $D_{Extend}$) which in turn pushes the swingarms 6 outward. The fender 3 is coupled to the swingarm bracket 16, so the fender 3 is also pushed outward.

In this arrangement, there are bevel gears 17,18 that accomplish fender rotation during horizontal translation. A horizontal bevel gear 17 is engaged with a vertical bevel gear 18, such as within the swingarm bracket 16. The horizontal bevel gear 17 is affixed to a drive shaft 21, which is affixed to one or both swingarms 6 located closest to the fender 3. The horizontal bevel gear 17 may be affixed to either end of the drive shaft 21, depending upon which direction of rotation is desired. Such arrangement causes, via the actuator 9A pushing and/or pulling the pushrod PR, the horizontal bevel gear 17 to rotate during the rotation of the swingarms 6.

The vertical bevel gear 18 is operatively engaged with the horizontal bevel gear 17, as discussed above, and is affixed to the fender 3 at the connection point 20. The vertical bevel gear 18 is supported by a shaft 19 affixed to the fender 3 whereby rotation of the vertical bevel gear 18 causes a respective rotation of the fender 3. In other words, if the vertical bevel gear 18 rotates, the fender 3 will also rotate in a one to one relationship. Likewise, if the fender 3 rotates, the vertical bevel gear 18 will rotate in a one to one relationship.

The vertical bevel gear 18 and fender 3 assembly is preferably rotatably supported by the swingarm bracket 16, such as the shaft extending through a bearing hole (not shown) in the swingarm bracket 16.

As the swingarms 6 are pushed outward, the horizontal bevel gear 17 will rotate clockwise (for example) which will in turn cause the vertical bevel gear 18 to rotate counter clock-wise and since the vertical bevel gear 18 is rigidly connected to the fender 3, the fender 3 will also rotate counter clock-wise.

As the swingarms 6 are pulled inward, the horizontal bevel gear 17 will rotate counter-clockwise, for example, which will in turn cause the vertical bevel gear 18 to rotate clockwise and since the vertical bevel gear 18 is rigidly connected to the fender 3, the fender 3 will also rotate clockwise. This rotation of the gears, as described above, is what causes the fender 3 to rotate from horizontal to vertical and vertical back to horizontal, during horizontal translation.

With the horizontal bevel gear 17 and the vertical bevel gear 18 engaged, the rotation of the fender 3 (and vertical bevel gear 18) will be in a one to one relationship with the rotation of the horizontal bevel gear 17 such that as horizontal bevel gear 17 rotates, so will the fender 3 (and vertical bevel gear 18) rotate. Depending on application, however, this one-to-one relationship from horizontal bevel gear 17 to fender 3 may not be desirable.

For instance, if the fender 3, when in its stowed and horizontal orientation, is stowed under the boat deck 5, some horizontal translation prior to rotation may be desirable. That is, the fender 3 may need to be pushed outward, beyond the edge of the deck 5, before beginning its rotation toward vertical. Conversely, when the fender 3 is being rotated from its vertical orientation back to its stowed, horizontal orientation, the fender 3 must be allowed to reach its horizontal orientation while the fender 3 is still sufficiently outside of the outer edge of the deck 5 to prevent interference thereby. Once in the horizontal orientation and outside of or past the outer edge of the deck 5, the swingarms 6 may then pull the fender 3, horizontally and somewhat linearly back into the stowed location, under the deck 5.

To accomplish this rotational delay of the fender 3 as it is being deployed and/or stowed, the bevel gear(s) 17,18 may be temporarily disengaged such that the fender 3 is allowed to be pushed out and/or pulled in, as described above, via linear motion only, and without any rotation. To accomplish this "delay" in rotary motion, the vertical bevel gear 18 and/or the horizontal bevel gear 17 may have one or more gear teeth that are omitted (not shown) such that the gears 17,18 are allowed to rotate past each other (i.e., are not engaged) during this portion of the movement of the fender 3. In this example, the fender 3 may be allowed to move horizontally outward (without any rotation) until the fender 3 clears the deck 5 at which point the gears may then engage and begin the rotation of the fender 3 from horizontal towards vertical, for example. In the other direction, the fender 3 may rotate from vertical towards horizontal at which point the fender 3 will be in the horizontal orientation and slightly outside of the boat deck 5 whereby the gears 17,18 will disengage due to the elimination of teeth in either or both (but preferably only one or the other) of the gears, as described above, and the final horizontal motion (without rotary motion) of the swingarms 6 will be used to pull the fender 3 inward and under the deck 5.

Figure 13:
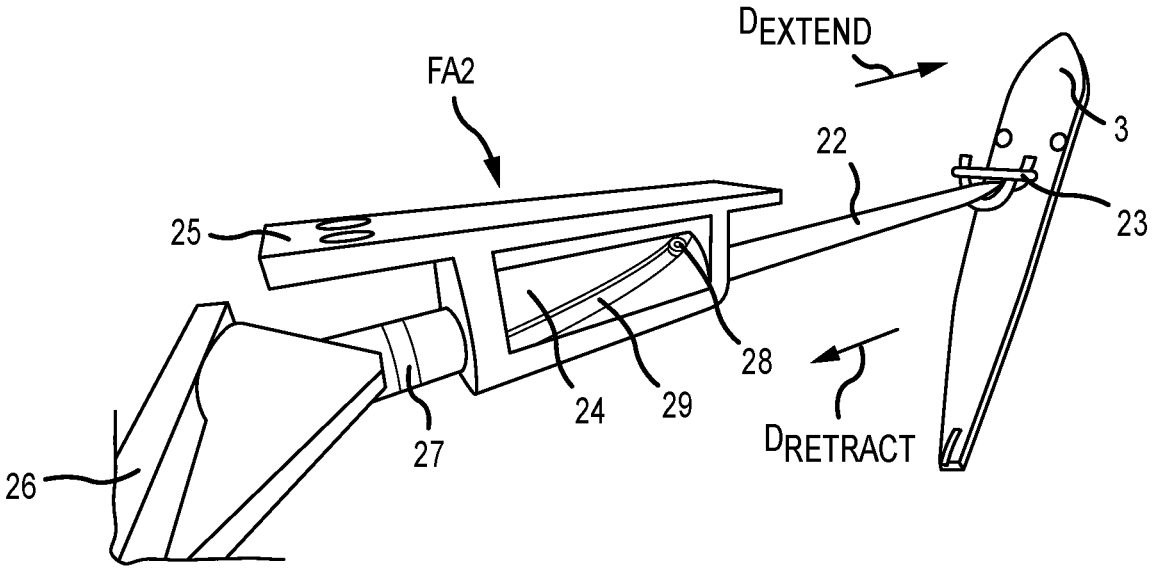
FIG. 13 is a left perspective view of an embodiment of a deployable fender system according to the present invention utilizing a second embodiment of an actuation mechanism according to the present invention.

FIG. 13 is a left perspective view of an embodiment of a deployable fender assembly FA2 according to the present invention utilizing a second embodiment of an actuation mechanism according to the present invention. Like the actuation mechanism including the bevel gears 17,18, this mechanism achieves desired rotational movement of a fender 3, through an at least substantially vertical plane, during horizontal translation. This fender assembly FA2 includes a linear actuator 9A (not shown, but as previously described) to operatively translate a push rail 26, which ultimately extends or retracts a pushrod 22 to which the fender 3 is connected. Affixed to, and radially extending from, the pushrod 22 is a rotational guide member, such as a protrusion, or knuckle, 28 which is situated in and adapted to slide along a guide slot, or race, 29 provided in a sleeve, or drum, 24. A connecting bracket 25 may be used to support the drum 24 stationarily with respect to a marine vessel frame (such as below a boat deck 5), as will be explained in more detail. The pushrod 22 moves back and forth horizontally through force applied by the actuator 9A pushing or pulling on the push rail 26 to which the actuator 9A is attached. A swivel attachment 27 may be located between the push rail 26 (on the one side) and the pushrod 22 (on the other end) to allow for pushrod 22 rotation as the actuator 9A moves the pushrod 22 linearly in and out thus imparting both linear and rotary motion to the pushrod 22. As the fender 3 is preferably rigidly attached to the pushrod 22, as the pushrod 22 moves in and out and rotates, as described above, so does the fender 3 move in and out and rotate.

The rotary motion is obtained as the guide knuckles 28 (only one shown here in FIG. 13, but preferably a second one is provided diametrically opposite the first) move linearly through the sleeve 24 which contains the curved guide slot, or race, 29 that causes the pushrod 22 (and fender 3) to rotate through a predetermined angle (e.g., at least about 45 degrees, and more preferably about 90 degrees).

With the actuator 9A retracted, the push rail 26, pushrod 22 and fender 3 will be retracted and the fender 3 will be in the horizontal and stowed orientation. As the actuator 9A begins to move in the first direction $D_{Extend}$, the push rail 26 begins to push the pushrod 22 through the sleeve 24. As the guide knuckles 28 on the pushrod 22 travel through the guide slot(s) 29 in the sleeve 24, the pushrod 22 rotates as it extends horizontally until such time as the pushrod 22 reaches its full linear and rotary stroke. As the actuator 9A moves in the second direction $D_{Retract}$, the push rail 26 pulls the pushrod 22 through the sleeve 24. As the guide knuckles 28 on the pushrod 22 travel through the guide slot(s) 29 in the sleeve 24, the pushrod 22 rotates as it extends horizontally until such time as the pushrod 22 reaches its full linear and rotary stroke.

The particular linear stroke (e.g., horizontal displacement) of the fender 3 and its corresponding parts, as described above, is not crucial so long as the system is designed such that the fender 3 is allowed to clear the bottom of the boat deck 5 (or other impedances) as the fender 3 extends out and begins to rotate from horizontal to vertical and such similar minimum clearance is provided as the fender is retracted back from vertical to horizontal. As further described below, minimal clearance and horizontal displacement limits may be defined by dimensions of the guide slot 29 and/or longitudinal placement of the knuckles 28 along the length of the pushrod 22.

Figure 14:
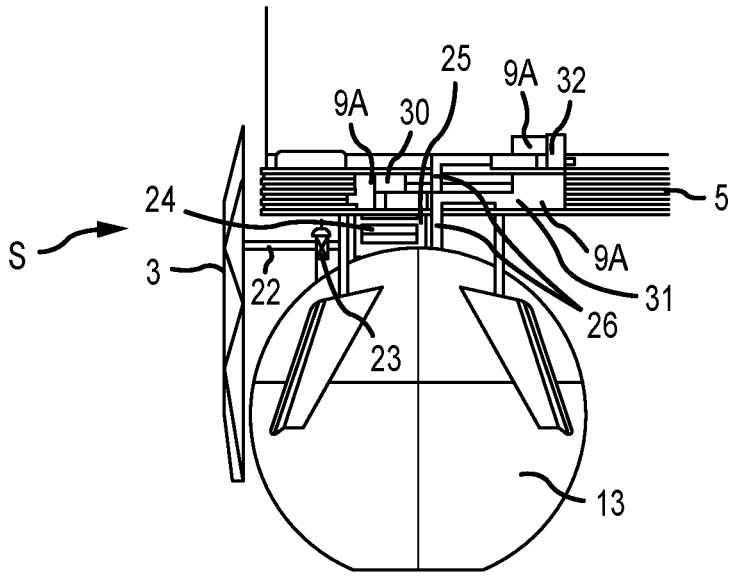
FIG. 14 is a front elevation view of a starboard side of a portion of an embodiment of a marine fender system according to the present invention depicting optional actuator mounting locations and fender in a first, deployed position.
Figure 15:
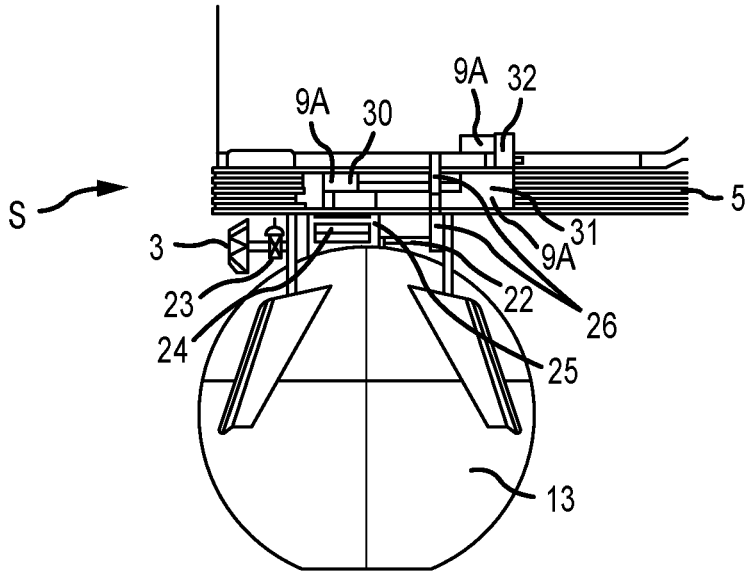
FIG. 15 is the embodiment of FIG. 14, showing the fender in a second, retracted position.

FIGS. 14 and 15 are elevation views showing alternative locations of an actuator 9A as the fender 3 is in its deployed and stowed orientations, respectively. A first location 30 includes an actuator 9A is inside of the deck 5 and is facing inward. The red 31 actuator 9 is inside of the deck 5 and is facing outward while the blue 32 actuator 9 is on top of the deck 5 and facing outward. The actuator 9A may be located in any reasonable location so long as, mechanically, its extend and retract motion causes linear travel of a pushrod to which the fender 3 is coupled. While three possible locations for actuators have been identified, only one actuator 9 is required for this application. Additionally, a longer push rail 26 may be incorporated into the system such that a single actuator 9A may be used to control multiple fenders 3, as more fully explained below. Alternatively, each fender 3 may have its own dedicated actuator 9A which may be synchronized with other actuator(s) 9A in a predetermined fashion.

While the fender systems discussed thus far show that the linear (and rotary) motion is obtained via the use of an actuator 9A, the system could similarly function manually such that there may be mechanical linkage and/or slides etc. that a person may manually activate the pushrod 22 in and out to cause the same linear and rotary motion to the pushrod 22 and fender 3.

Turning now to FIG. 16-20, another embodiment 100 of a marine fender system is shown installed on a boat frame 150, such as a pontoon boat frame, for example. The frame 150 is secured to a plurality of pontoons 13 and the assembly is shown floating in water W. In this embodiment, an extendable frame 110 may be used such that more than one (and more preferably all) of the fenders 3 on the port side P or starboard side S of the vessel may be attached to the frame 110. As the frame 110 extends outward (such as by operation of one or more actuators 9A), so do the fenders 3 that are attached to the frame 110. When the frame 110 is retracted inward, so are all of the fenders 3, which are attached to the frame 110, retracted inward substantially simultaneously. Additionally, the frame 110 may be positioned in its extended position to extend outwardly approximately the same distance as the fenders 3 to somewhat protect the fenders 3 from being damaged by protrusions sticking out from a dock or seawall, for example. The frame 110 may have a lead-in 112 (or transition rail) at the bow and/or stern such that the frame 110 itself may be allowed to slide past protrusions that may stick out from the dock or seawall, for example. The lead-ins 112 may be flexible members or they may be hinged such that when the frame 110 (and fenders 3) are retracted back into their stowed location underneath the boat deck 5 (removed in this Figure), the frame 110 and the fenders 3 are preferably prevented from protruding radially outward past the deck 5 as discussed in connection with FIG. 2 above.

An arrangement of multiple fenders 3 attached to a single frame 110 allows deployment and/or stowage all of the fenders 3 attached to that frame 110 at the same or substantially contemporaneous time with just a single actuator control (which may control multiple actuators 9A simultaneously) that is used to push or to pull on the frame 110 as compared to having to deploy and/or stow each fender 3 individually.

Figure 16:
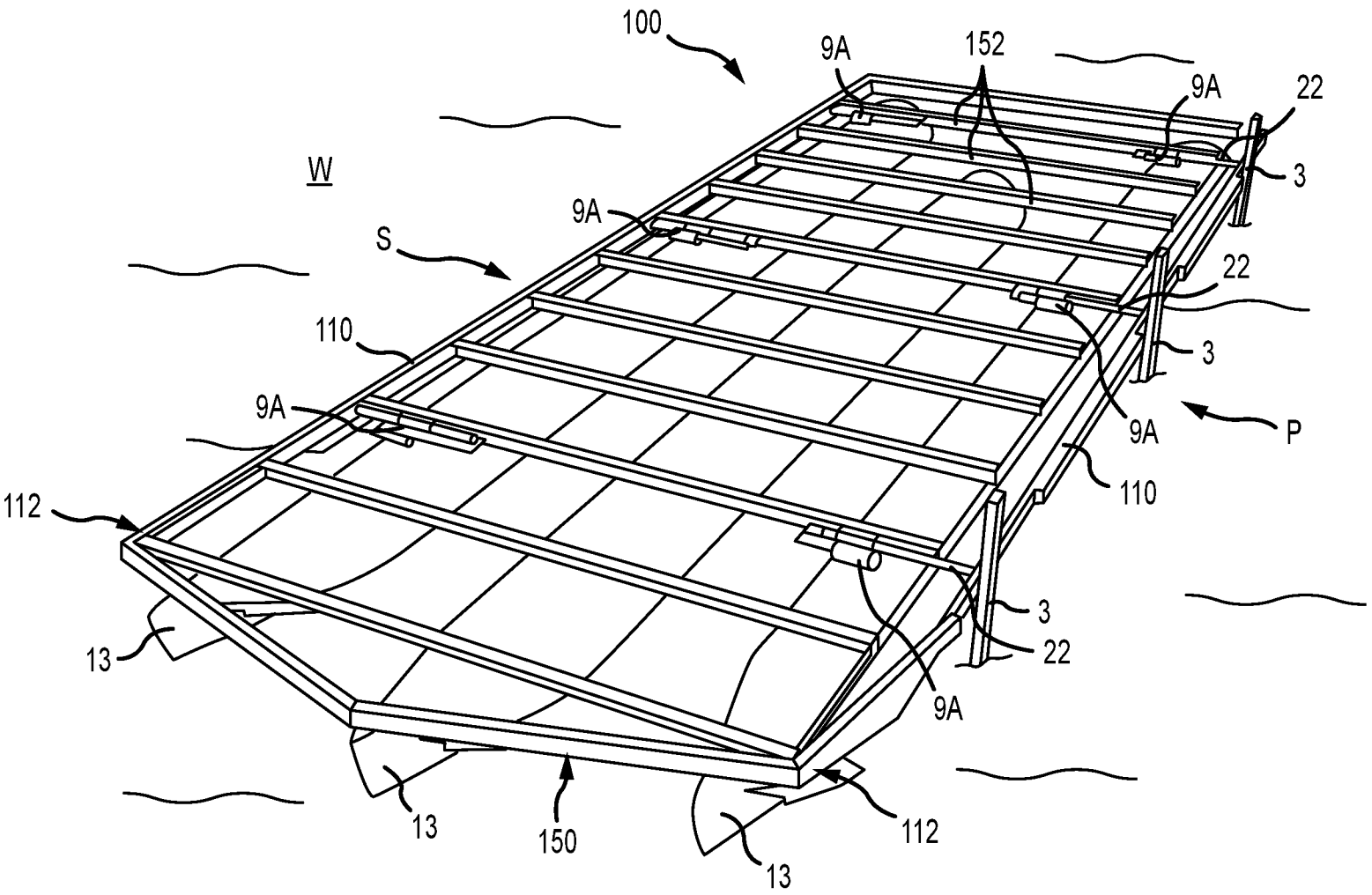
FIG. 16 is a first perspective view of a pontoon boat framework including an embodiment of a deployable fender system according to the present invention utilizing a third embodiment of an actuation mechanism according to the present invention.
Figure 17:
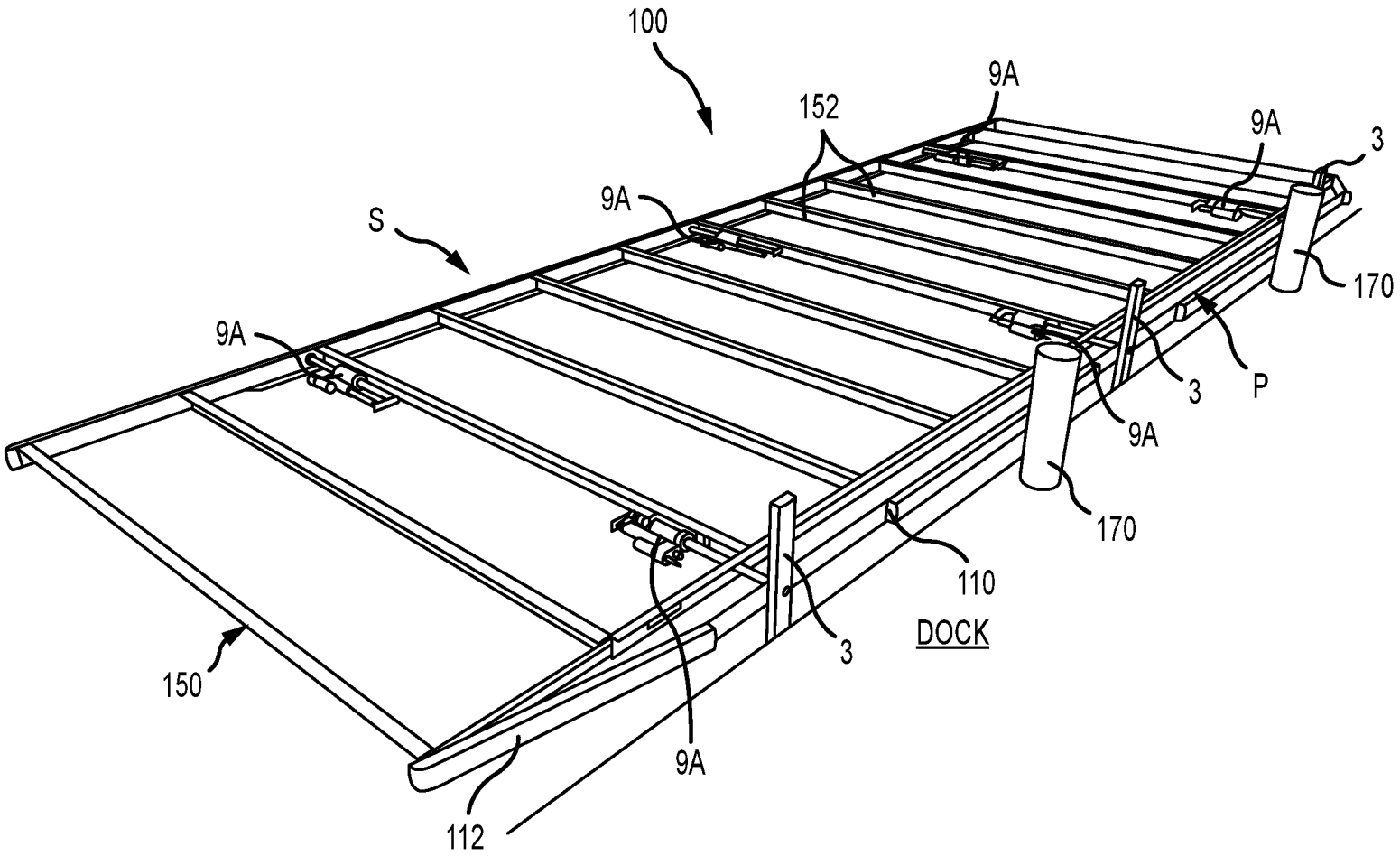
FIG. 17 is a perspective view of the framework of FIG. 16 situated near a dock.

FIG. 17 depicts the embodiment 100 of FIG. 16 (pontoons 13 removed from view) situated near a dock. Thus, the port side P of a marine vessel is moored near the dock, and boat lines (e.g, rope, not shown) may be secured to piers or pilings 170 or other structure on the dock. The fenders 3 (shown coupled to a rail 110) located on the port side P have been extended by one or more actuators 9A mounted on transverse members 152 of the frame 150. The transverse members 152 may be preexisting (such as if actuators 9A and fenders 3 are retrofitted to a prefabricated marine vessel) or one or more members 152 may be added to support actuators 9A. The transverse members 152 may generally have a C-shaped or I-shaped cross-section, providing top and bottom flanges to be secured to other vessel structure, such as a boat deck 5 and pontoons 13, respectively. In a preferred orientation, an actuator 9A is mounted on a transverse member 152 to avoid interference with other mounting structure. For example, if other mounting structure is provided through a bottom flange on the stern side of a transverse member 152, then an actuator 9A is preferably mounted to the bow side of that transverse member 152. Such mounting may be accomplished preferably with mechanical fasteners, such as nuts and bolts, screws, or with adhesive or welding. Alternatively, each fender 3 may be supported without the moveable rail 110 and may be extended and retracted with a dedicated actuator 9A. Regardless of the number of fenders 3 and/or actuators 9A implemented, while each fender 3 may be controlled separately if provided with a dedicated actuator 9A, it is preferable to actuate all fenders 3 on a particular side or both sides of the vessel. In other words, actuator control is preferably provided operatively to extend or retract all fenders 3 on the starboard side S of the vessel and/or the port side P of the vessel.

Figure 18:
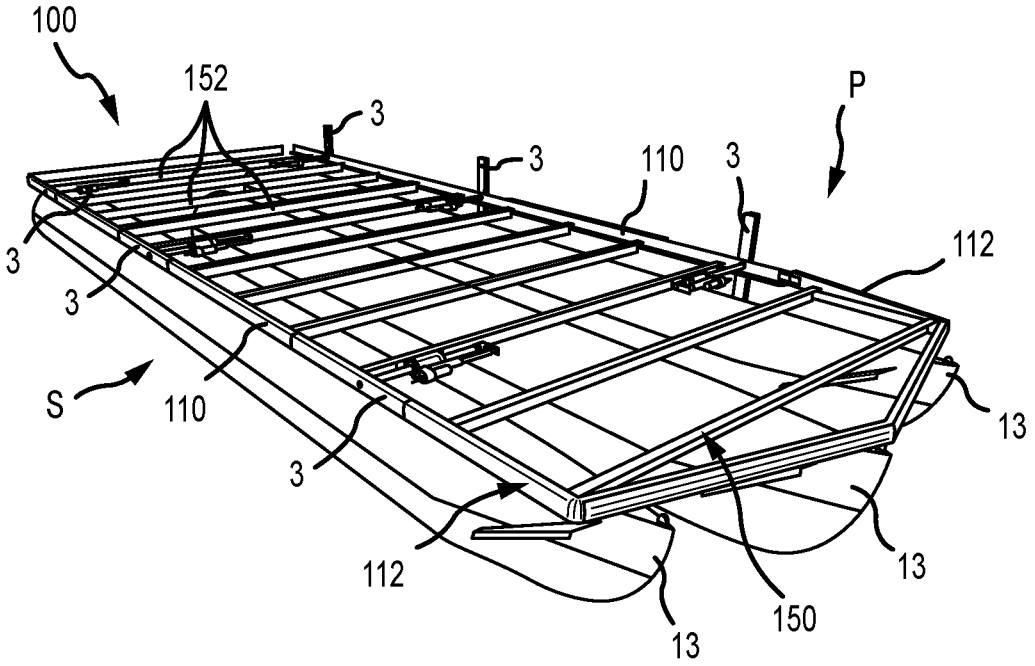
FIG. 18 is a second perspective view of the embodiment of FIG. 16.

FIG. 18 shows a starboard side S view of the embodiment 100 of FIG. 16, with starboard fenders 3 retracted while port fenders 3 are deployed.

Figure 19:
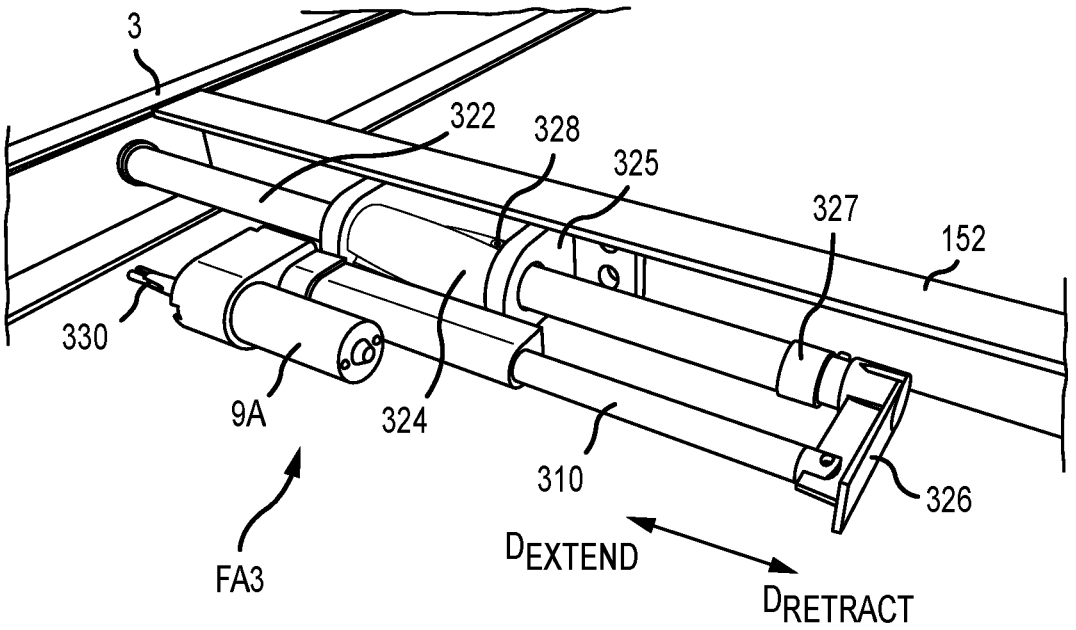
FIG. 19 is a first perspective view of the third embodiment of an actuation mechanism according to the present invention.
Figure 20:
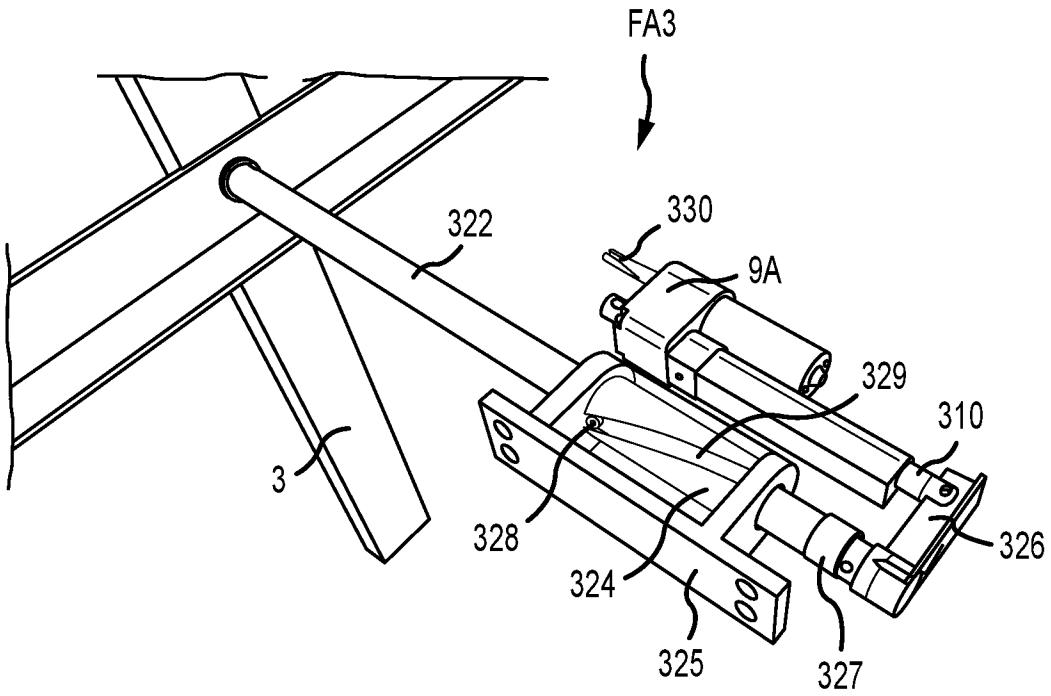
FIG. 20 is a second perspective view of the embodiment of FIG. 19, further eliminating a portion of pontoon framework for clarity.

FIGS. 19 and 20 depict a third embodiment FA3 of a deployable fender assembly according to the present invention utilizing a third embodiment of an actuation mechanism according to the present invention. This mechanism achieves desired rotational movement of a fender 3, through an at least substantially vertical plane, during horizontal translation. This fender assembly FA3 includes a linear actuator 9A to operatively translate a push rail 326, which ultimately extends or retracts a pushrod 322 to which the fender 3 is connected. The linear actuator 9A of this embodiment FA3 may be said to be facing inward, because extension of an actuator piston 310 is in the direction of $D_{Retract}$, which causes a fender to be retracted inward towards the vessel. Affixed to, and radially extending from, the pushrod 322 is a protrusion, or knuckle, 328 which is situated in and adapted to slide along a guide slot, or race, 329 provided in a sleeve, or drum, 324. A connecting bracket 325 may be used to support the drum 324 stationarily with respect to a marine vessel frame (such as on a transverse frame member 152). The pushrod 322 can reciprocate horizontally through force applied by the actuator 9A pushing or pulling (through an actuation piston 310) on the push rail 326 to which the actuator 9A is attached. A swivel attachment 327 may be located between the push rail 326 (on the one side) and the pushrod 322 (on the other end) to allow for pushrod 322 rotation as the actuator 9A moves the pushrod 322 linearly in and out thus imparting both linear and rotary motion to the pushrod 322. As the fender 3 is preferably rigidly attached to the pushrod 322, as the pushrod 322 moves in and out and rotates, as described above, so does the fender 3 move in and out and rotate.

The rotary motion is obtained as the guide knuckles 328 (only one shown here in FIG. 19, but preferably a second one is provided diametrically opposite the first) move linearly through the sleeve 324 which contains the curved guide slot, or race, 329 that causes the pushrod 322 (and fender 3) to rotate through a predetermined angle (e.g., at least about 45 degrees, and more preferably about 90 degrees). The knuckles 328 may be provided as a simple pin or a bearing cam follower supported by the pushrod 322.

The actuator 9A may receive control signals over a control input 330, which may be an electrical input or a pneumatic input. The control input 330 causes the actuator 9A to extend or retract. Control signals are preferably sent directly or indirectly from the helm of the vessel, such that fenders 3 can be deployed and retracted easily and preferably substantially simultaneously by a single person. With the actuator 9A extended, the push rail 326, pushrod 322 and fender 3 will be retracted and the fender 3 will be in the horizontal and stowed orientation. As the actuator 9A begins to move in the first direction $D_{Extend}$, the push rail 326 begins to push the pushrod 322 through the sleeve 324. As the guide knuckles 328 on the pushrod 322 travel through the guide slot(s) 329 in the sleeve 324, the pushrod 322 rotates as it extends horizontally until such time as the pushrod 322 reaches its full linear and rotary stroke. As the actuator 9A moves in the second direction $D_{Retract}$, the push rail 326 pulls the pushrod 322 through the sleeve 324. As the guide knuckles 328 on the pushrod 322 travel through the guide slot(s) 329 in the sleeve 324, the pushrod 322 rotates as it retracts horizontally until such time as the pushrod 322 reaches its full linear and rotary stroke.

Figure 21:
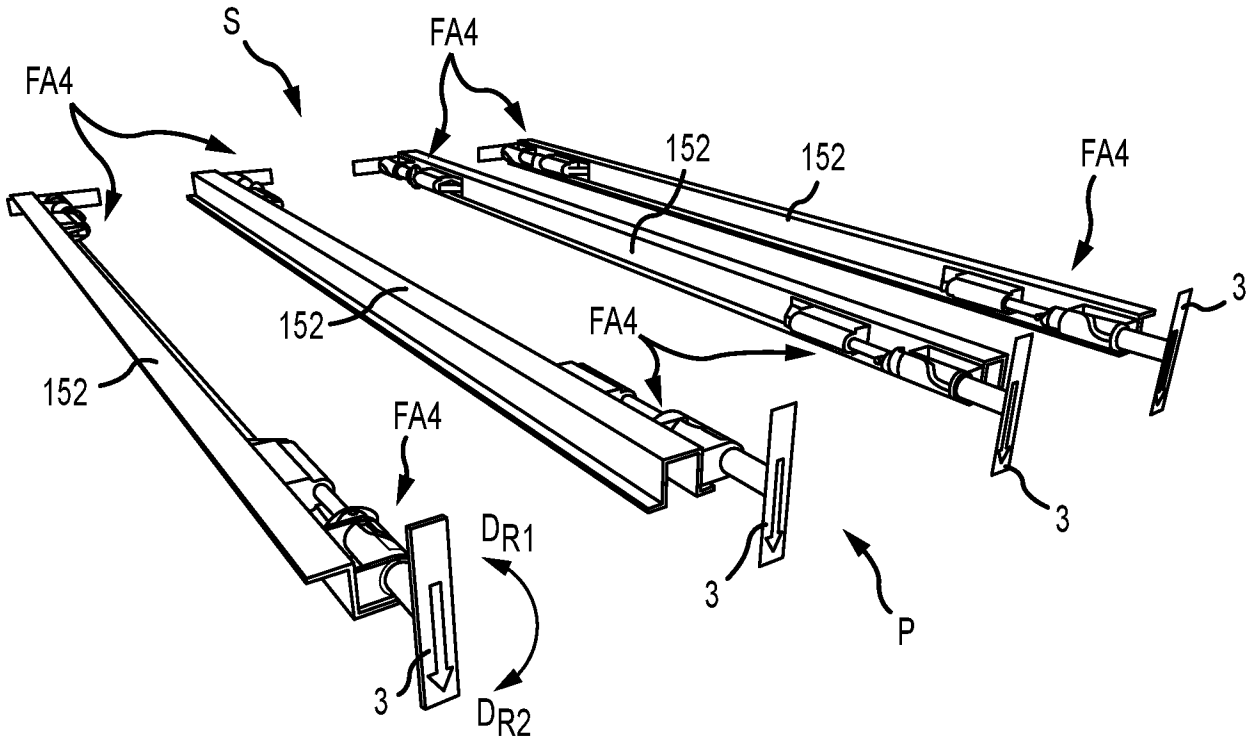
FIG. 21 is a first perspective view of a pontoon boat framework including an embodiment of a deployable fender system according to the present invention utilizing a fourth embodiment of an actuation mechanism according to the present invention.

With reference to FIG. 21, optional fender assembly (shown as fender assembly FA4, further described in connection with FIG. 22) mounting locations and operation can be discussed. If multiple fender assemblies FA4 are provided on the port side P of a marine vessel, for example, all of the assemblies FA4 may be mounted on the same fore or aft side of transverse frame members 152, or the assemblies may be mounted on different sides of the members, as shown. While discussed with reference to the fourth embodiment FA4 of a fender assembly, it should be understood that such mounting options are generally available to the other embodiments, as well. One advantage of using the bevel gear assembly FA1, and the cam/race arrangements FA2-4, driven by a linear actuator 9A is that mounting on either side of the transverse frame members 152 should not affect rotational direction of the fenders 3. That is, it may be desirable to cause all fenders 3 on the port side P, for example, to rotate in a counterclockwise motion $D_{R1}$ or a clockwise motion $D_{R2}$. It may also be desirable to cause fenders 3 on the starboard side S to rotate in an opposite direction from the fenders 3 on the port side P, such that when fenders 3 are deployed from the helm, all fenders 3 seem to rotate fore (port side P fenders 3 counterclockwise $D_{R1}$ and starboard side S fenders 3 clockwise) or aft (port side P fenders 3 clockwise $D_{R2}$ and starboard side S fenders 3 counterclockwise).

Figure 22:
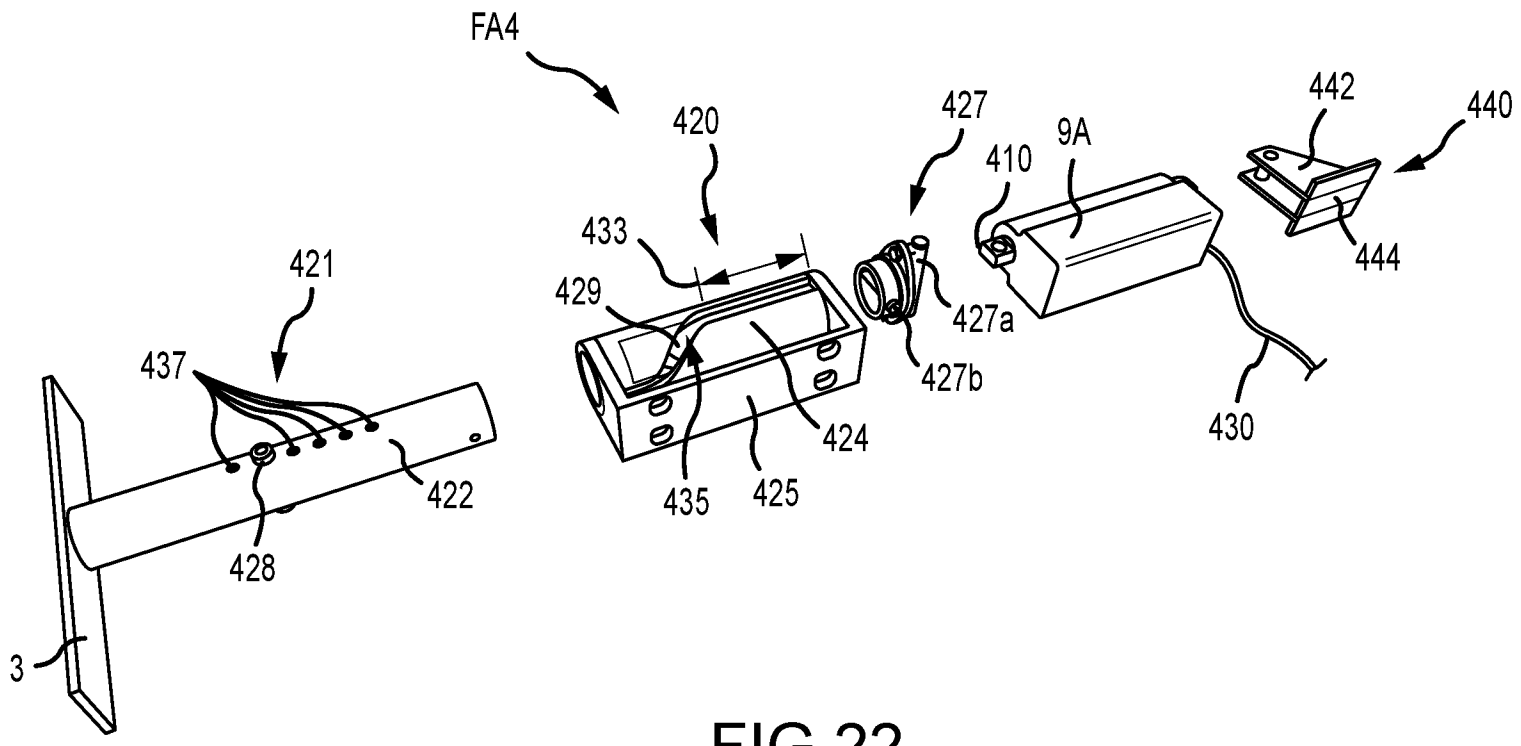
FIG. 22 is a perspective assembly view of the fourth embodiment of an actuation mechanism according to the present invention.

FIG. 22 depicts a fourth embodiment FA4 of a deployable fender assembly according to the present invention utilizing a fourth embodiment of an actuation mechanism according to the present invention. This mechanism achieves desired rotational movement of a fender 3, through an at least substantially vertical plane, during horizontal translation. Unlike the third embodiment FA3, this embodiment FA4 does not require a push rail 326. Thus, the linear actuator 9A of this embodiment FA4 may be said to be facing outward, because extension of an actuator piston 410 is in the direction of $D_{Extend}$, which causes a fender 3 to be extended outward from the vessel. This fender assembly FA4 includes a linear actuator 9A to operatively extend or retract a pushrod 422 to which the fender 3 is connected. Affixed to, and radially extending from, the pushrod 422 is a protrusion, or knuckle, 428 which is situated in and adapted to slide along a guide slot, or race, 429 provided in a sleeve, or drum, 424. The race 429 is preferably formed with a longitudinal delay length 433 followed by a rotational diversion 435. A connecting bracket 425 may be used to support the drum 424 stationarily with respect to a marine vessel frame (such as on a transverse frame member 152). The pushrod 422 can reciprocate horizontally through force applied by the actuator 9A pushing or pulling (through the actuation piston 410) on the push rail 426 to which the actuator 9A is attached.

A swivel attachment 427 may be located between the actuation piston 410 (on the one side 427*a*) and the pushrod 422 (on the other end 427*b*) to allow for pushrod 422 rotation as the actuator 9A moves the pushrod 422 linearly in and out thus imparting both linear and rotary motion to the pushrod 422. The second side 427*b* of the swivel attachment 427 may be formed as a pillow block ball bearing with a locking collar. The first side 427*a* may be formed as a u-bolt style connection. As the fender 3 is preferably rigidly attached to the pushrod 422, as the pushrod 422 moves in and out and rotates, as described above, so does the fender 3 move in and out and rotate.

An end of the actuator 9A may be coupled to a marine vessel, such as a transverse frame member 152, by using a mounting bracket 440, including a pair of mounting flanges 442 and a mounting plate 444. The mounting flanges 442 preferably link an actuator connection point to the mounting plate 444 and the plate 444 is then secured to the marine vessel.

The rotary motion is obtained as the guide knuckles 428 (only one shown here in FIG. 22, but preferably a second one is provided diametrically opposite the first) move linearly through the sleeve 424 which contains the curved guide slot, or race, 429 that causes the pushrod 422 (and fender 3) to rotate through a predetermined angle (e.g., at least about 45 degrees, and more preferably about 90 degrees). The knuckles 428 may be provided as a simple pin or a bearing cam follower supported by the pushrod 422.

The actuator 9A may receive control signals over a control input 430, which may be an electrical input or a pneumatic input. The control input 430 causes the actuator 9A to extend or retract. Control signals are preferably sent directly or indirectly from the helm of the vessel, such that fenders 3 can be deployed and retracted easily and preferably substantially simultaneously by a single person. With the actuator 9A retracted, the pushrod 422 and fender 3 will be retracted and the fender 3 will be in the horizontal and stowed orientation. As the actuator 9A begins to move in the first direction $D_{Extend}$, the actuation piston 410 begins to push the pushrod 422 through the sleeve 424. The longitudinal delay length 433 allows for longitudinal translation of the pushrod 422 while preventing rotation, which may be desirable to allow the fender 3 to clear rotational obstacles defined by other structure on the marine vessel on which the system is installed. Once clearance has been achieved, the rotational diversion 435 imparts rotation to the push rod 422. That is, as the guide knuckles 428 on the pushrod 422 travel through the guide slot(s) 429 in the sleeve 424, the pushrod 422 rotates as it extends horizontally until such time as the pushrod 422 reaches its full linear and rotary stroke. As the actuator 9A moves in the second direction $D_{Retract}$, the push rail 426 pulls the pushrod 422 through the sleeve 424. As the guide knuckles 428 on the pushrod 422 travel through the guide slot(s) 429 in the sleeve 424, the pushrod 422 rotates as it retracts horizontally until such time as the pushrod 422 reaches its full linear and rotary stroke. The rotational guide member 428 may be located at a particular predefined longitudinal location along the length of the pushrod 422. Alternatively, additional longitudinal locations 437 may be provided, to allow for mounting a clearance adjustment for a particular marine vessel. The longitudinal distance from the fender 3 to the rotational guide members 428, along with the profile of the race 429 can thus be adjusted and combined for optimal performance on a given vessel.

The foregoing is considered as illustrative only of the principles of the invention. Furthermore, since numerous modifications and changes will readily occur to those skilled in the art, it is not desired to limit the invention to the exact construction and operation shown and described. For instance, while terms like "vertical" and "horizontal" are used throughout, the terms are intended for general reference. Though technically such terms may include precise vertical and horizontal directionality, such precision is not required to fall within the scope of the description. While the preferred embodiment has been described, the details may be changed without departing from the invention, which is defined by the claims.

We claim:

1. A marine fender system comprising:

a fender; and a pushrod coupled to the fender, the pushrod being reciprocally moveable between and including a first longitudinal position and a second longitudinal position;

wherein longitudinal movement of the pushrod translates to substantially horizontal translation of the fender and rotation of the pushrod translates to rotation of the fender in a substantially vertical plane, wherein as the pushrod moves between the first longitudinal position and the second longitudinal position, the pushrod rotates a predetermined angle of less than one hundred eighty degrees, the pushrod supporting a rotational guide member at a longitudinal location along a length of the pushrod.

2. A marine fender system according to claim 1, further comprising:

an actuator operatively coupled to the pushrod to impart longitudinal movement to the pushrod.

3. A marine fender system according to claim 2, wherein the actuator comprises a linear actuator.

4. A marine fender system according to claim 2, wherein the actuator is electrically controlled and/or operated.

5. A marine fender system according to claim 2, wherein the actuator is pneumatically controlled and/or operated.

6. A marine fender system according to claim 1, wherein the rotational guide member comprises a radial protrusion from the pushrod.

7. A marine fender system according to claim 1, wherein the rotational guide member comprises a bearing cam follower.

8. A marine fender system according to claim 1, the system further comprising:

a stationary rotational guide sleeve disposed circumferentially about the pushrod; and a race defined along an inner surface of the guide sleeve, wherein the rotational guide member is received within the race.

9. A marine fender system according to claim 1, the system further comprising:

a bumper disposed on at least one of an outer surface of the fender and an inner surface of the fender.

10. A marine fender system according to claim 9, wherein the bumper has a lower durometer than the fender.

11. A marine vessel adapted for travel on water, the vessel comprising:

a port side and a starboard side;

a first plurality of fenders disposed along one of the port side and the starboard side;

a plurality of pushrods, each being coupled to one of the fenders, the pushrods being reciprocally moveable between and including a first longitudinal position and a second longitudinal position;

wherein longitudinal movement of each pushrod translates to substantially horizontal translation of the respective fender and rotation of each pushrod translates to rotation of the respective fender in a substantially vertical plane, wherein as each pushrod moves between the first longitudinal position and the second longitudinal position, the pushrod rotates a predetermined angle of less than one hundred eighty degrees, wherein each pushrod is independently reciprocally moveable; and at least one linear actuator operatively coupled to the pushrods to impart longitudinal movement to the pushrods, wherein one linear actuator is operatively coupled to each pushrod, wherein an extension of one of the linear actuators causes a radially inward longitudinal movement of the respective pushrod with respect to the vessel.

* * * * *